US011073068B2

(12) United States Patent
Takada et al.

(10) Patent No.: US 11,073,068 B2
(45) Date of Patent: Jul. 27, 2021

(54) EXHAUST DEVICE EQUIPPED WITH SPARK ARRESTER

(71) Applicant: HONDA MOTOR CO., LTD., Tokyo (JP)

(72) Inventors: Hideaki Takada, Wako (JP); Sho Takada, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 185 days.

(21) Appl. No.: 16/275,691

(22) Filed: Feb. 14, 2019

(65) Prior Publication Data

US 2019/0284984 A1 Sep. 19, 2019

(30) Foreign Application Priority Data

Mar. 13, 2018 (JP) ..... JP2018-045269

(51) Int. Cl.

| | |
|---|---|
| ***B01D 39/00*** | (2006.01) |
| ***F01N 13/18*** | (2010.01) |
| ***F01N 3/06*** | (2006.01) |
| *F04C 29/06* | (2006.01) |
| *F01N 1/16* | (2006.01) |

(Continued)

(52) U.S. Cl.

CPC ..... *F01N 13/1844* (2013.01); *F01N 3/06* (2013.01); *F01N 1/08* (2013.01); *F01N 1/16* (2013.01); *F01N 13/082* (2013.01); *F01N 2260/20* (2013.01); *F01N 2290/00* (2013.01); *F04C 29/065* (2013.01); *Y10S 55/20* (2013.01);

(Continued)

(58) Field of Classification Search

CPC ..... F01N 13/1844; F01N 3/06; F01N 13/082; F01N 2290/00; F01N 1/16; F01N 1/08; F01N 2260/20; F01N 3/021; F01N 3/0217; Y10S 55/20; Y10S 261/09; Y10S 55/30; F23J 15/022; B01D 46/0039; B01D 46/4272; B01D 2273/00; B01D 2279/30

See application file for complete search history.

(56) References Cited

U.S. PATENT DOCUMENTS 1,355,761 A * 10/1920 Jones ..... F23J 15/022 55/422
4,419,113 A * 12/1983 Smith ..... B01D 46/0021 422/562

(Continued)

FOREIGN PATENT DOCUMENTS

| | | |
|---|---|---|
| CN | 1985079 A | 6/2007 |
| CN | 101395346 A | 3/2009 |
| JP | H06-76619 | 10/1994 |

OTHER PUBLICATIONS

Chinese Office Action dated Oct. 29, 2020, with English translation, 16 pages.

*Primary Examiner* — Dung H Bui
(74) *Attorney, Agent, or Firm* — Rankin, Hill & Clark LLP

(57) ABSTRACT

According to an aspect of the present invention, it is possible to easily support a spark arrester and prevent an occurrence of damage or sound in the spark arrester due to the effect of an exhaust pressure or external vibration. In a spark arrester, at least a flange part is formed of a spring member. The flange part includes a bent part that is telescopically bent by elastic deformation in a direction along a flow of exhaust gas. The bent part is supported between a tail pipe and a muffler in a state where the elastic deformation of the bent part is allowed.

5 Claims, 10 Drawing Sheets

(51) Int. Cl.
*F01N 13/08* (2010.01)
*F01N 1/08* (2006.01)

(52) U.S. Cl.
CPC ..... *Y10S 55/21* (2013.01); *Y10S 181/403* (2013.01); *Y10S 181/404* (2013.01)

(56) References Cited

U.S. PATENT DOCUMENTS 5,306,881 A * 4/1994 Kiyooka ..... F01N 13/1805 181/227
5,866,859 A * 2/1999 Karlsson ..... F01N 1/08 181/230
7,174,991 B1 * 2/2007 Gunnarsson ..... F01N 1/084 181/231
2001/0037912 A1 * 11/2001 Menzel ..... F01N 3/06 181/231
2003/0136607 A1 * 7/2003 Kawamata ..... F01N 1/083 181/231
2003/0233943 A1 * 12/2003 Siska ..... B01D 46/44 96/417
2010/0163337 A1 * 7/2010 Sugishita ..... F01N 1/166 181/264
2011/0277454 A1 * 11/2011 Christianson ..... F01N 3/06 60/297
2014/0360808 A1 * 12/2014 Fujimoto ..... F01N 1/084 181/231
2016/0166968 A1 * 6/2016 Lee ..... B01D 46/4272 55/356
2016/0214048 A1 * 7/2016 Koester ..... B01D 46/009
2017/0252690 A1 * 9/2017 Maischak ..... B01D 46/2403

* cited by examiner

EXHAUST DEVICE EQUIPPED WITH SPARK ARRESTER

INCORPORATION BY REFERENCE

The present application claims priority under 35 U.S.C. § 119 to Japanese Patent Application No. 2018-045269 filed on Mar. 13, 2018. The content of the application is incorporated herein by reference in its entirety.

BACKGROUND OF THE INVENTION

Field of the Invention

The present invention relates to an exhaust device equipped with a spark arrester.

Description of the Related Art

An exhaust device having a structure in which a spark arrester is attached to an exhaust pipe or a muffler is known.

As support structures for the spark arrester of this type, there are a fastening structure for fastening the spark arrester using bolts, and a nipping structure for nipping the spark arrester between parts. For example, Japanese Utility Model Laid-Open No. H06-76619 discloses a structure in which one end side of a spark arrester is loosely fit to a wall surface of a cylinder, the other end side of the spark arrester engages with a wall portion of a muffler, and the spark arrester is held in elastic contact between two walls by using a fastening force of bolts used to fix the muffler.

SUMMARY OF THE INVENTION

However, in the fastening structure, the number of parts is more likely to increase, a fastening work is more likely to be complicated, and the shape of each part is more likely to be complicated. On the other hand, in the nipping structure, the clearance depending on the spark arrester is required, the spark arrester vibrates due to the effect of the external vibration or exhaust pressure of an engine or the like, and the spark arrester contacts another member, which may cause damage or sound.

Accordingly, an object of the present invention is to easily support a spark arrester and prevent an occurrence of damage or sound in the spark arrester due to the effect of an exhaust pressure or external vibration.

To attain the above-described object, according to an aspect of the present invention, an exhaust device equipped with a spark arrester includes a spark arrester. The spark arrester includes a net-like main body part through which exhaust gas passes, and a flange part with a diameter enlarged from the main body part, at least the flange part being formed of a spring member. The flange part includes a bent part that is telescopically bent by elastic deformation in a direction along a flow of the exhaust gas. The bent part is supported in a state where the elastic deformation of the bent part is allowed.

In the structure described above, the bent part has a structure in which a part of the flange part is bent toward one of an upstream side and a downstream side of the exhaust gas.

In the structure described above, the flange part is a member formed by bending, as the bent part, three outer peripheral portions at intervals in a circumferential direction toward one of an upstream side and a downstream side of the exhaust gas with respect to an annular plate material in a front view.

In the structure described above, the exhaust device includes an exhaust port through which the exhaust gas is exhausted, and the spark arrester is provided at a position where an external appearance is visible from the exhaust port.

In the structure described above, the spark arrester is provided at a position where a part of the spark arrester projects from the exhaust port depending on an exhaust gas pressure acting on the spark arrester.

According to the present invention, the spark arrester includes a net-like main body part through which exhaust gas passes, and a flange part with a diameter enlarged from the main body part, at least the flange part being formed of a spring member. The flange part includes a bent part that is telescopically bent by elastic deformation in a direction along a flow of the exhaust gas. The bent part is supported in a state where the elastic deformation of the bent part is allowed. Therefore, it is possible to easily support the spark arrester by using the elasticity of the bent part, and to prevent an occurrence of damage or sound in the spark arrester due to the effect of an exhaust pressure or external vibration.

The bent part has a structure in which a part of the flange part is bent toward one of an upstream side and a downstream side of the exhaust gas. Therefore, the bent part can be easily provided.

The flange part is a member formed by bending, as the bent part, three outer peripheral portions at intervals in a circumferential direction toward one of an upstream side and a downstream side of the exhaust gas with respect to an annular plate material in a front view. Therefore, the flange part can be easily fabricated.

The exhaust device includes an exhaust port through which the exhaust gas is exhausted, and the spark arrester is provided at a position where an external appearance is visible from the exhaust port. Therefore, the state of the spark arrester can be easily checked.

The spark arrester is provided at a position where a part of the spark arrester projects from the exhaust port depending on an exhaust gas pressure acting on the spark arrester. Therefore, a clogged state or the like of the spark arrester can be easily checked.

DETAILED DESCRIPTION OF THE PREFERRED EMBODIMENTS

Embodiments of the present invention will be described below with reference to the drawings.

First Embodiment

Figure 1:
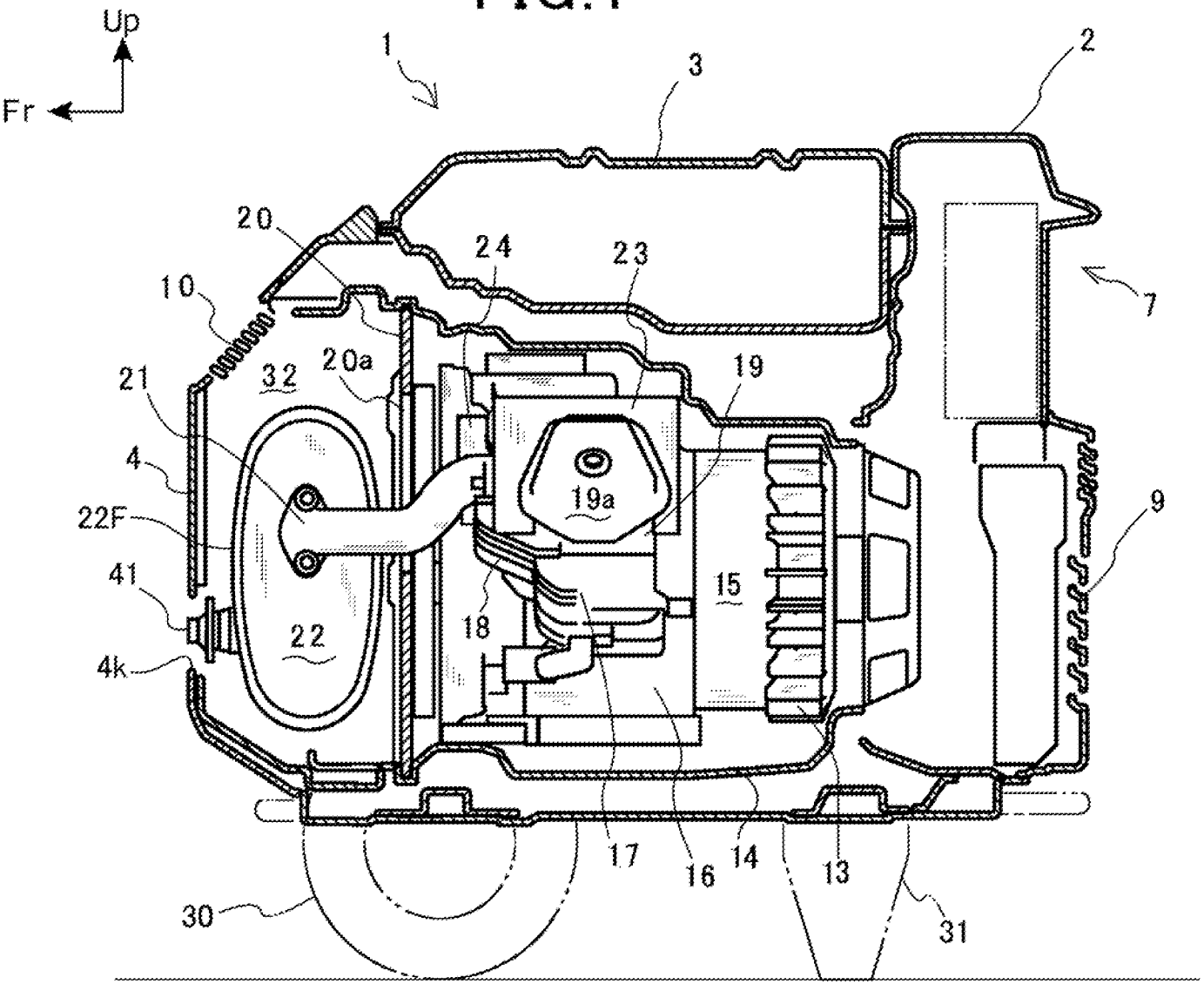
FIG. 1 is a side sectional view illustrating an internal structure of an engine generator to which an exhaust device according to a first embodiment is applied.
Figure 2:
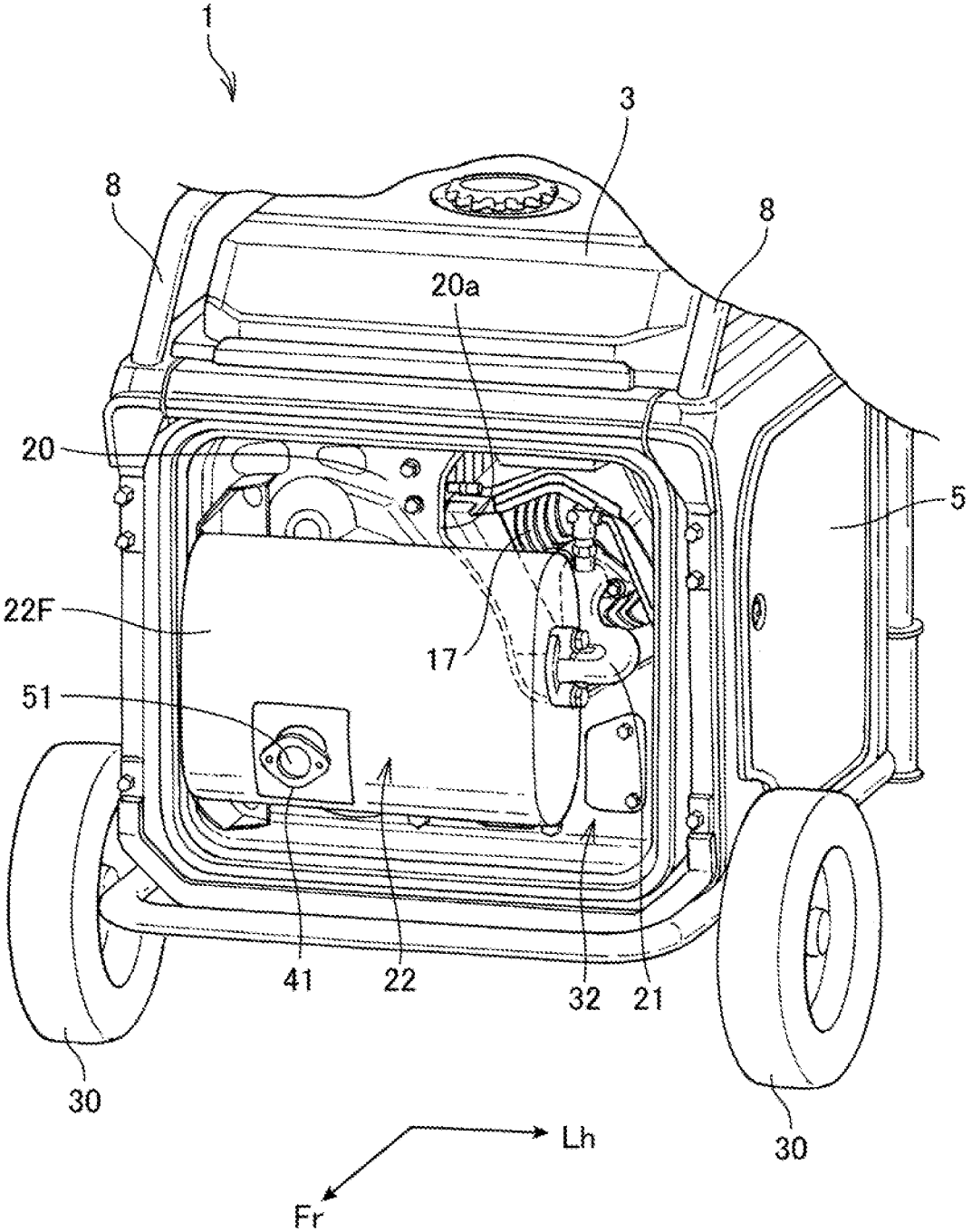
FIG. 2 is a perspective view illustrating the exhaust device of the engine generator, and peripheral components.

FIG. 1 is a side sectional view illustrating an internal structure of an engine generator to which an exhaust device according to a first embodiment is applied. FIG. 2 is a perspective view illustrating the exhaust device of the engine generator and peripheral components. In FIGS. 1 and 2, the upward side of the engine generator is indicated by "Up", the front side of the engine generator is indicated by "Fr", and the left side of the engine generator is indicated by "Lh".

An engine generator 1 includes a housing 2. A fan 13, a generator 15, an engine 16, and an exhaust pipe 21 and a muffler 22, which constitute an exhaust device, are supported in the housing 2.

As illustrated in FIG. 2, in the housing 2, a front cover 4 (FIG. 1) that covers a front surface of the housing 2 (corresponding to a front surface of the engine generator 1), and a pair of right and left maintenance covers 5 that cover right and left portions of the housing 2 (corresponding to right and left portions of the engine generator 1), respectively, are detachably provided. For convenience of description, FIG. 2 illustrates a state where the front cover 4 is detached.

As illustrated in FIG. 1, at a back surface of the engine generator 1, a control panel 7 that functions as, for example, an operation part for inputting a user instruction, and a cooled air intake port 9 through which an outside air is taken in as cooled air are provided vertically at an interval. In the control panel 7, in addition to various operation elements, a display part that displays an operation state and the like, an output terminal that outputs generated electric power, and the like are disposed.

The front cover 4 constituting the front surface of the engine generator 1 is provided with an opening portion 4K through which a tail pipe 41 constituting an exhaust part of the muffler 22 is exposed to the outside, and a cooled air discharge port 10 through which cooled air flowing into the front cover 4 is discharged upward.

A fuel tank 3 is disposed at an upper portion of the engine generator 1, and guard members 8 (see FIG. 2) that guard the fuel tank 3 are disposed at right and left portions of the fuel tank 3, respectively, in such a manner that the guard members 8 extend in a front-and-back direction.

In the housing 2 of the engine generator 1, the fan 13, the generator 15, the engine 16, the exhaust pipe 21, and the muffler 22 are disposed in this order from the back side. The rotation of the fan 13 allows the cooled air to flow in from the cooled air intake port 9, and the cooled air sequentially cools the generator 15, the engine 16, the exhaust pipe 21, and the muffler 22.

A partition wall 20 is provided between the engine 16 and the muffler 22. The cooled air flows into the muffler 22 side through a vent hole 20*a* provided in the partition wall 20, and the cooled air is discharged from the cooled air discharge port 10 provided in the front cover 4.

At a lower front portion of the housing 2, a pair of right and left wheels 30, which enable the engine generator 1 to travel, is rotatably supported. At a lower back portion of the housing 2, a stand 31 that supports the engine generator 1 is provided. In the case of transporting the engine generator 1, the back portion of the engine generator 1 is raised by a handle for transportation (not illustrated) to separate the stand 31 from the ground, and the wheels 30 enable the engine generator 1 to freely move easily.

As illustrated in FIG. 1, in the housing 2 of the engine generator 1, the fan 13, the generator 15, the engine 16, the exhaust pipe 21, and the muffler 22 are disposed in this order from the back side. The fan 13, the generator 15, and the engine 16 are covered with a duct 14, the back end (corresponding to the side where the cooled air intake port 9 is located) of the duct 14 is opened.

The rotation of the fan 13 allows the cooled air to be introduced into the duct 14 through the cooled air intake port 9, and the cooled air cools the generator 15 and the engine 16. The cooled air that has cooled the generator 15 and the engine 16 enters an exhaust box 32, which is defined by the partition wall 20 and the front cover 4, through the vent hole 20*a* provided in the partition wall 20, and is discharged from the cooled air discharge port 10 of the front cover 4.

The generator 15 is driven by the engine 16 and generates electric power. The generated electric power is adjusted to a predetermined electric power, and the electric power is then output from the output terminal provided on the control panel 7.

The engine 16 is an internal combustion engine that obtains power by burning fuel in the fuel tank 3, and includes a crankcase 17, a cylinder block 18 connected to the crankcase 17, and a cylinder head 19 connected to the cylinder block 18. The cylinder head 19 includes a suction port and an exhaust port which lead to the inside of the cylinder block 18. A suction system, which is not illustrated, is connected to the suction port, and an upstream end of the exhaust pipe 21 is connected to the exhaust port.

The exhaust pipe 21 extends at the front side (corresponding to the side where the muffler 22 is located) toward a side portion (left side surface) of the muffler 22 from the cylinder head 19, and is coupled to the side portion of the muffler 22.

The muffler 22 is accommodated in the exhaust box 32, i.e., the space defined by the partition wall 20 and the front cover 4. The muffler 22 and the exhaust pipe 21 constitute the exhaust device (also referred to as an exhaust system) of the engine generator 1.

The muffler 22 is formed in a tubular shape extending in the right-and-left direction in the exhaust box 32. A downstream end of the muffler 22 is connected to one of the right and left side surfaces (left side surface in this embodiment), and the tail pipe 41 constituting an outlet for exhaust gas is provided on a front surface 22F that is opposed to the front cover 4.

Although the shape of the muffler 22 is not particularly limited, the muffler 22 having the structure described above is formed with an elliptic section that is longer in the vertical direction than in the front-and-back direction. This structure makes it possible to efficiently ensure the capacity of the muffler while preventing the muffler 22 from projecting toward the front side of the engine generator 1.

Further, the area of the front surface 22F of the muffler 22 can be increased, and the tail pipe 41 is provided on the increased front surface 22F, which leads to an improvement in the degree of freedom of arrangement of the tail pipe 41. In addition, an operation for attaching or detaching the tail pipe 41 can be easily performed.

A known silencer structure of, for example, an inversion type or a multi-stage expansion type is provided in the muffler 22, so that the exhaust gas can be discharged to the outside by sufficiently reducing the exhaust pressure. Further, a catalytic converter or the like for purifying the exhaust gas may be disposed in the muffler 22.

As illustrated in FIG. 2, when the front cover 4 is detached, the muffler 22, the exhaust pipe 21, and the like can be exposed to the outside, so that a user, a maintenance operator, or the like can easily access the muffler 22 and the exhaust pipe 21.

Figure 3:
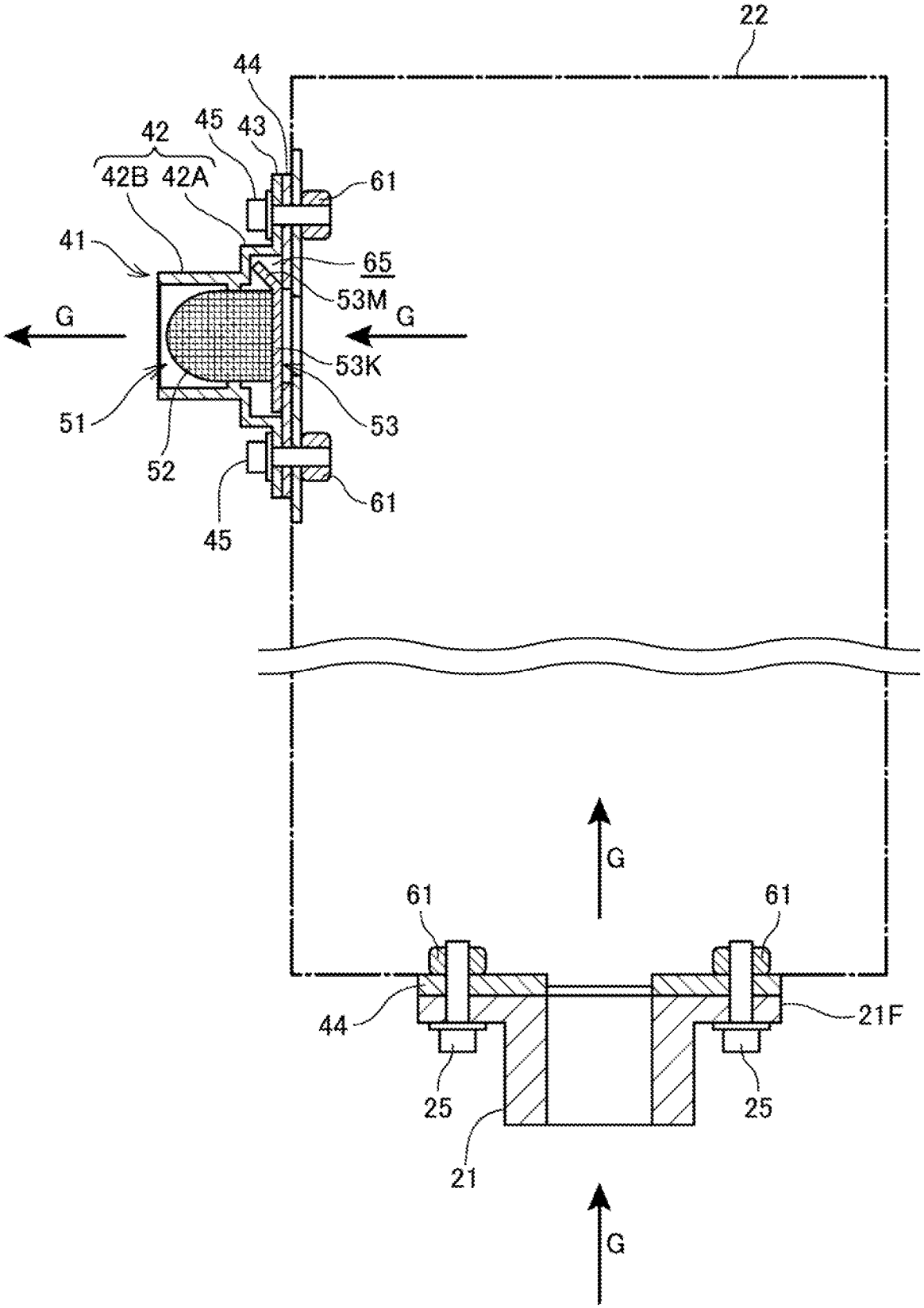
FIG. 3 is a schematic top view illustrating a connecting section between a tail pipe and an exhaust pipe of a muffler.

FIG. 3 is a schematic top view illustrating a connecting section between the tail pipe 41 and the exhaust pipe 21 of the muffler 22. In FIG. 3, the arrow G indicates a flow of exhaust gas.

As illustrated in FIG. 3, a spark arrester 51 is disposed in the tail pipe 41. The spark arrester 51 prevents discharge of fuel particles included in the exhaust gas. The spark arrester 51 includes a net-like main body part 52 through which the exhaust gas passes, and a flange part with a diameter enlarged from the main body part 52. Each flange part 53 is nipped between the tail pipe 41 and the muffler 22.

Specifically, the tail pipe 41 includes a tubular tail pipe main body 42 (corresponding to a tubular main body part) and a flange part 43 with a diameter enlarged at the upstream end of the tail pipe main body 42. The tail pipe main body 42 and the flange part 43 are integrally formed. A gasket 44 is provided between the flange part 43 and the muffler 22. The flange part 43 is fixed to the muffler 22 by fastening members 45 (a pair of bolts in this embodiment). The tail pipe 41 can be easily detached from the muffler 22 by detaching the fastening members 45.

The tail pipe main body 42 includes a muffler 22-side portion 42A (hereinafter referred to as the muffler-side portion 42A), and a portion 42B located on the opposite side of the muffler 22 (hereinafter referred to as the downstream-side portion 42B), which are integrated with each other. The muffler-side portion 42A is formed with a diameter larger than that of the downstream-side portion 42B.

The main body part 52 of the spark arrester 51 is formed with a size that is equal to or smaller than the inner diameter of the downstream-side portion 42B which is a relatively small-diameter portion of the tail pipe 41. The flange part 53 of the spark arrester 51 is formed with a size that is equal to or larger than the inner diameter of the downstream-side portion 42B of the tail pipe 41 and is smaller than the muffler-side portion 42A.

As illustrated in FIG. 3, the flange part 53 of the spark arrester 51 falls within a space 65 formed between the muffler-side portion 42A and the muffler 22. Accordingly, the spark arrester 51 is positioned between the tail pipe 41 and the muffler 22 and is thus prevented from dropping out of the tail pipe 41. The spark arrester 51 can be detached by detaching the tail pipe 41 from the muffler 22, so that a maintenance work, such as cleaning or replacement of the spark arrester 51, can be easily performed.

Like the tail pipe 41, the exhaust pipe 21 is also provided with a flange part 21F. The flange part 21F is fastened to the muffler 22 by fastening members 25 (a pair of bolts in this embodiment). The gasket 44 is also provided between the flange part 21F of the exhaust pipe 21 and the muffler 22. In FIG. 3, female screws 61 (e.g., weld nuts) which are provided in the muffler 22 and used to fasten the fastening members 45 and 25 are indicated by 61.

Figure 4A:
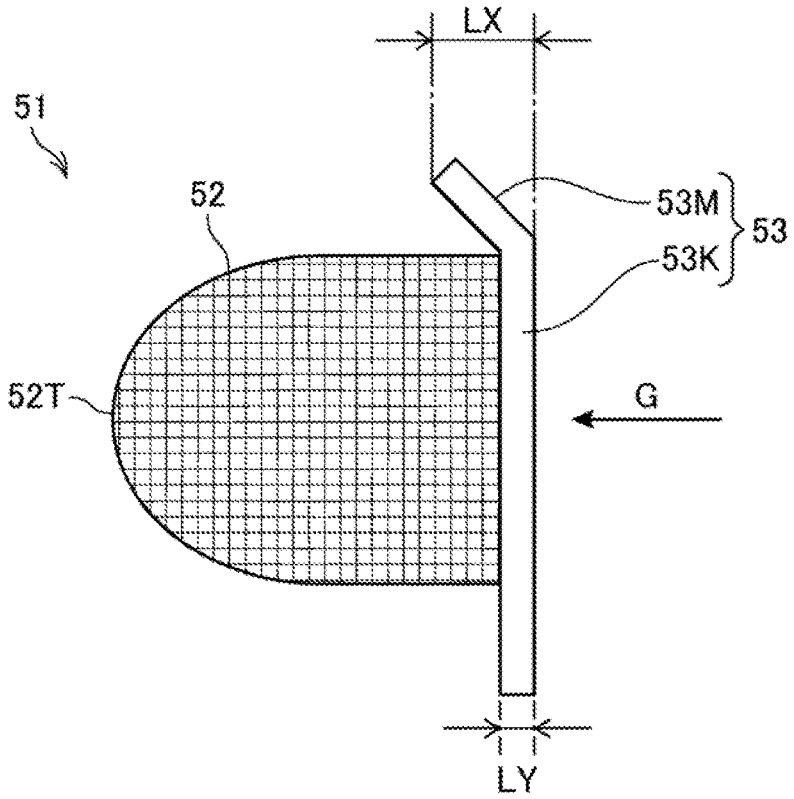
FIG. 4A is a side view of the spark arrester.
Figure 4B:
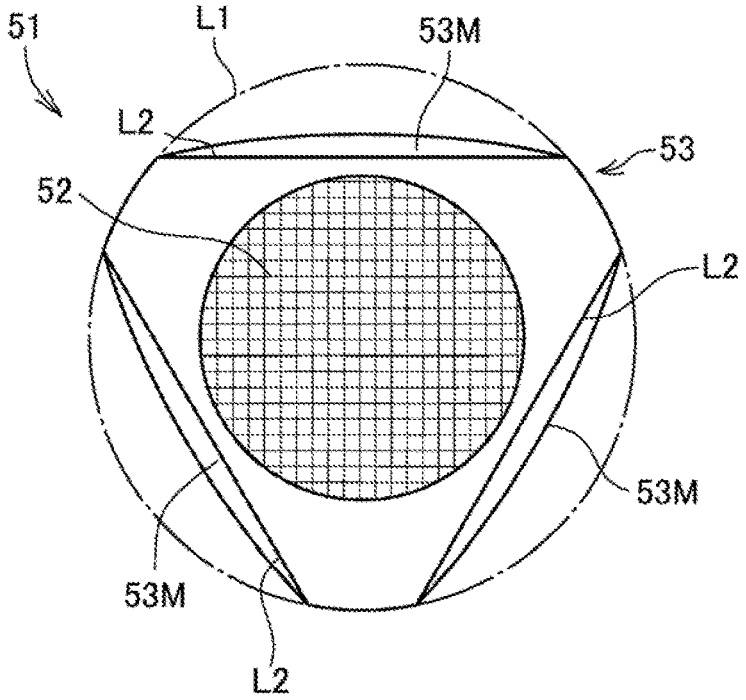
FIG. 4B is a front view of the spark arrester.

FIG. 4A is a side view of the spark arrester 51, and FIG. 4B is a front view of the spark arrester 51. In FIG. 4A, an arrow G indicates a flow of exhaust gas.

The main body part 52 and the flange part 53 of the spark arrester 51 are each formed of a metallic material. At least the flange part 53 is formed of a spring member used for a spring material. As the material of the main body part 52, any metallic material can be applied within a range that satisfies a heat resistance or the like.

As long as the heat resistance, elasticity, or the like can be sufficiently satisfied, a nonferrous metallic material can be used for the flange part 53. For example, ceramics that can be used as a spring material may be used.

As illustrated in FIGS. 4A and 4B, the main body part 52 is formed of a cylindrical net-like body extending along the direction in which the exhaust gas flows, an exhaust-gas-downstream-side end 52T is closed with the same net-like body, and an exhaust-gas-upstream-side end is opened. The main body part 52 traps fuel particles included in the exhaust gas, thereby preventing discharge of the fuel particles. As the main body part 52, the structure of a known spark arrester can be widely applied.

The flange part 53 is formed by partially bending an annular plate material in a front view. More specifically, a plurality of outer peripheral portions are bent in the direction along the flow of exhaust gas at intervals in the circumferential direction with respect to an annular member 53K in a complete round shape in a front view, thereby forming the flange part 53 including a plurality of bent parts 53M.

In FIG. 4B, an alternate long and short dash line indicated by L1 represents a visible outline of the flange part 53 before being bent, and an area indicated by L2 represents a bent section. In this embodiment, the outer peripheral portions are bent toward the downstream side of the exhaust gas at regular angular intervals of 120° in a front view, so as to obtain three bent parts 53M.

Each bent part 53M functions as a sprint portion that expands or contracts by elastic deformation in the direction along the flow of exhaust gas. In FIG. 4A, the natural length of each bent part 53M, i.e., the length in the direction along the flow of exhaust gas, is indicated by a value LX, and the plate thickness of the flange part 53 is indicated by a value LY.

Figure 5A:
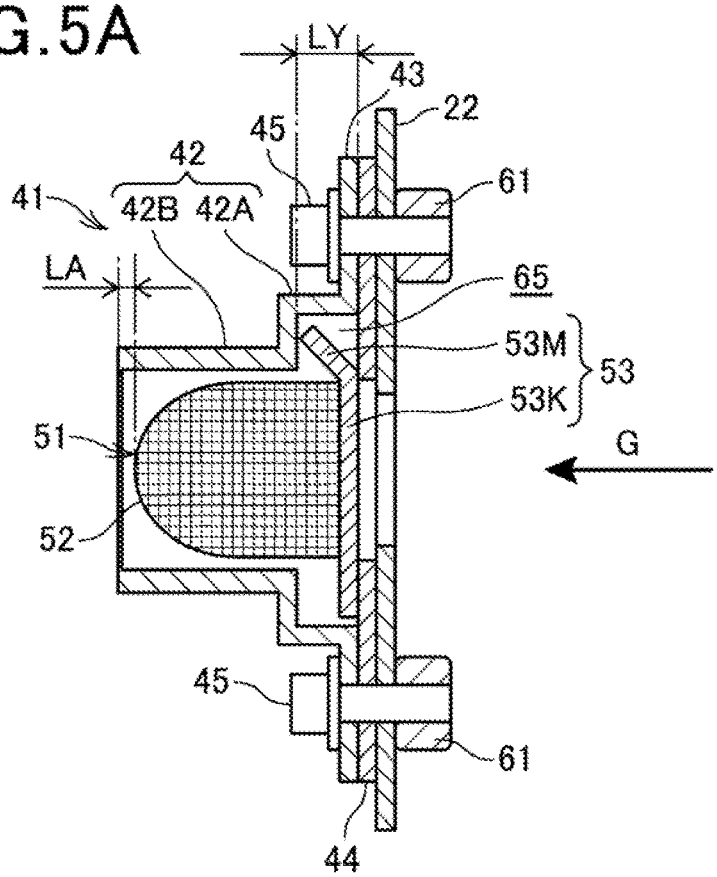
FIG. 5A is a diagram illustrating the spark arrester and the peripheral components when an exhaust gas pressure is zero or low.
Figure 5B:
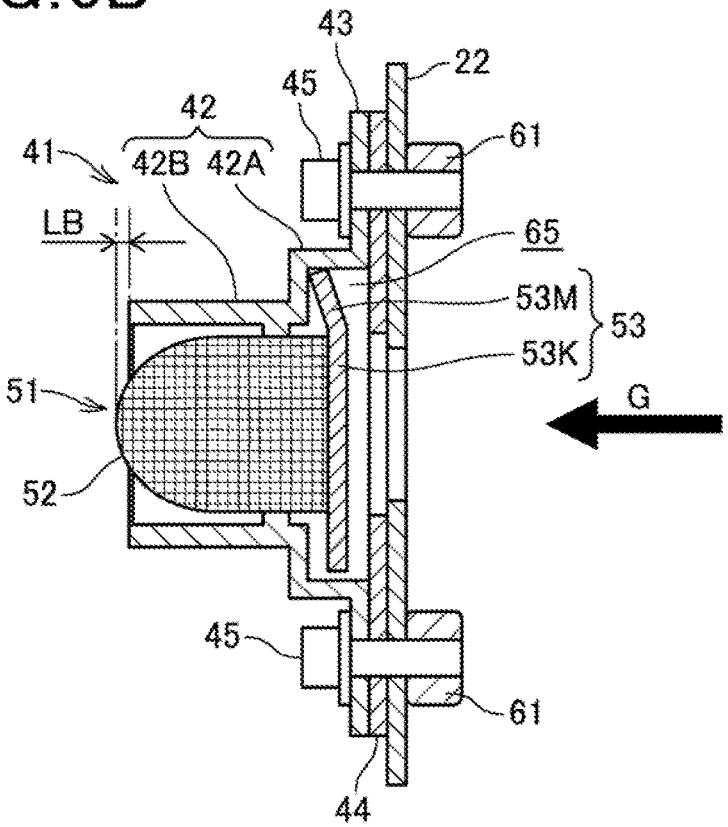
FIG. 5B is a diagram illustrating the spark arrester and the peripheral components when the exhaust gas pressure is high.

FIGS. 5A and 5B are diagrams each illustrating the spark arrester 51 and the peripheral components. Specifically, FIG. 5A illustrates a case where an exhaust gas pressure is zero or low (e.g., a case where the engine speed is low). FIG. 5B illustrates a case where the exhaust gas pressure is high (e.g., a case where the engine speed is high).

As described above, the flange part 53 of the spark arrester 51 is accommodated in the space 65 formed between the muffler-side portion 42A and the muffler 22. In FIG. 5A, the length of the space 65 (the length in the direction along the flow of exhaust gas) is indicated by the value LY. The value LY is set to be greater than the plate thickness LY (FIG. 4A) of the flange part 53 and equal to or less than the length LX of each bent part 53M.

With this structure, the flange part 53 is nipped between the muffler-side portion 42A and the muffler 22, so that the spark arrester 51 can be easily held, and external vibrations and vibrations of the spark arrester 51 due to the effect of the exhaust pressure can be suppressed.

As illustrated in FIG. 5B, when the exhaust gas pressure is high, each of the bent parts 53M of the flange part 53 of the spark arrester 51 is deformed and the spark arrester 51 is displaced toward the downstream side of the exhaust gas, thereby preventing the application of an excess load on the spark arrester 51.

Therefore, when the spark arrester 51 is clogged, and when a situation (afterburn) in which unburned gas is burnt in the exhaust pipe 21 occurs, damage to the net portion of the spark arrester 51, or the occurrence of a flaw or sound due to a contact of the spark arrester 51 with another member can be easily avoided.

According to this embodiment, in a state illustrated in FIG. 5A, the main body part 52 of the spark arrester 51 is located on the inside of the back end of the tail pipe 41 by an amount corresponding to the value LA. On the other hand, in a state illustrated in FIG. 5B, the main body part 52 protrudes outward from the back end of the tail pipe 41 by an amount corresponding to the value LB.

Accordingly, a part of the spark arrester 51 enters into or exits from the tail pipe 41 depending on the exhaust gas pressure acting on the spark arrester 51, thereby making it possible to easily check the clogged state or the like of the spark arrester 51 from the outside.

The value LA is preferably set to a value that enables visual recognition of the spark arrester 51 from the outside, while fully avoiding a situation where the spark arrester 51 contacts outside members, for example, when the engine generator 1 in a stopped state is moved. With this structure, it is possible to easily check the clogged state, while avoiding a physical damage during movement of the spark arrester 51.

Next, the shape of each of the main body part 52 and the flange part 53 of the spark arrester 51 will be described.

The net portion of the main body part 52 is formed in a cylindrical shape or hemispherical shape so that the exhaust gas can be circulated as uniformly as possible in all directions. The cylindrical shape or hemispherical shape is advantageous in that the shape has a less planar part and thus the rigidity can be easily ensured.

The flange part 53 is formed in an annular shape with the same opening shape as the opening shape of the main body part 52 so that the exhaust gas is circulated to the main body part 52 having a cylindrical shape or hemispherical shape. Further, since the flange part 53 is a portion that is held between the tail pipe 11 and the muffler 22, it is desirable to form the flange part 53 with a light weight and a compact size, while preventing the flange part 53 from being undesirably deformed. Accordingly, the flange part 53 is preferably formed in an annular shape with a minimum width while preventing undesirable deformation.

Next, the reason that the flange part 53 is formed in an annular shape will be described.

Figure 6A:
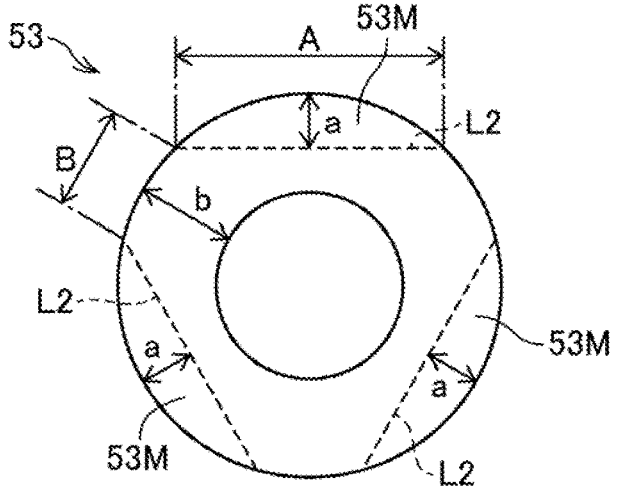
FIG. 6A is a diagram illustrating a case where three bent parts are formed on an annular flange part.
Figure 6B:
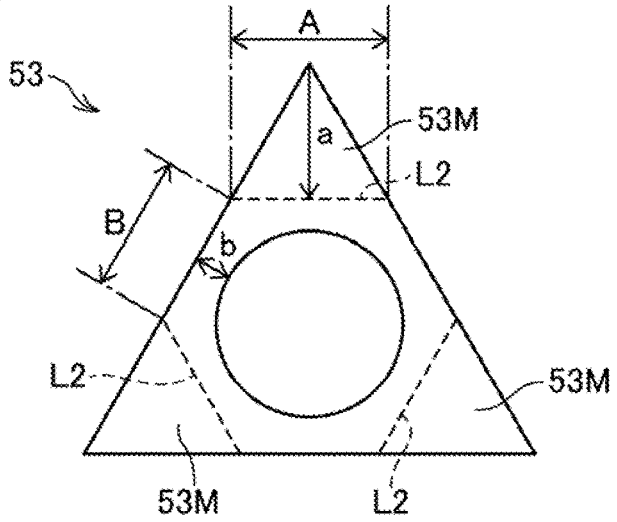
FIG. 6B is a diagram illustrating a case where three bent parts are formed on the triangular flange part.
Figure 6C:
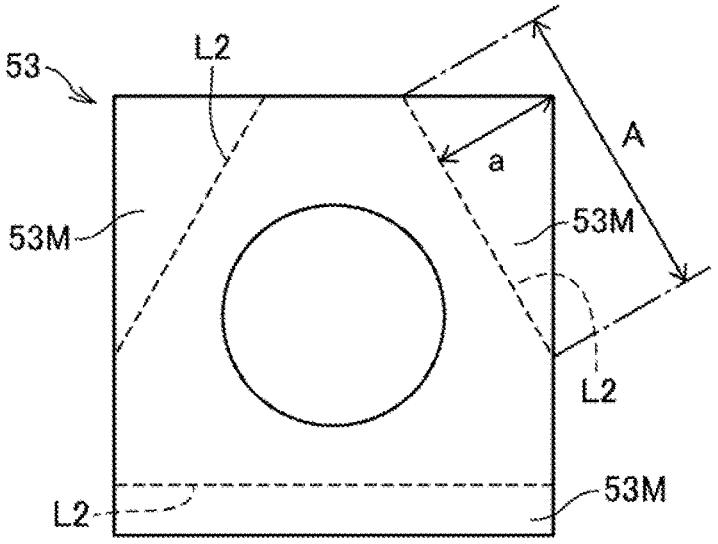
FIG. 6C is a diagram illustrating a case where three bent parts are formed on the quadrangular flange part.

FIG. 6A illustrates a case where three bent parts 53M are formed on the annular flange part 53, like in this embodiment. FIG. 6B illustrates a case where three bent parts 53M are formed on the triangular flange part 53. FIG. 6C illustrates a case where three bent parts 53M are formed on the quadrangular flange part 53.

In FIGS. 6A to 6C, the width of each bent part 53M is represented by a value "A", the distance between the bent parts 53M is represented by a value "B", a maximum height of each bent part 53M is represented by a value "a", and the width of the flange part 53 is indicated by a value "b".

As illustrated in FIGS. 6A to 6C, in the annular flange part 53 illustrated in FIG. 6A, the lengths of both the values "B" and "b" can be ensured, unlike the other flange parts 53, and thus the flange part 53 is excellent in mounting stability. In the triangular flange part 53 illustrated in FIG. 6B, the length of the value "B" can be increased, while the length of the value "b" is short. Accordingly, the triangular flange part 53 is inferior in mounting stability. In the quadrangular flange part 53 illustrated in FIG. 6C, the shapes of the bent parts 53M are not uniform. Accordingly, the quadrangular flange part 53 is inferior in installation stability.

In addition, referring to FIG. 6A, a tip end (a section in contact with the muffler-side portion 42A of the tail pipe 11) of each of the bent parts 53M has a shape along an arc. Thus, each of the bent parts 53M is substantially in point contact with the muffler-side portion 42A. Therefore, the flange part 53 can be supported at three points, and thus the spark arrester 51 can be appropriately held even when the shapes of respective parts are not uniform.

The annular flange part 53 illustrated in FIG. 6A can provide the same advantageous effect as a conventional spring washer (e.g., a wave washer). Consequently, the number of parts can be reduced and manhours for assembly can be reduced, while the advantageous effect of the spring washer can be obtained.

Next, the reason that three bent parts 53M are provided will be described.

Figure 7A:
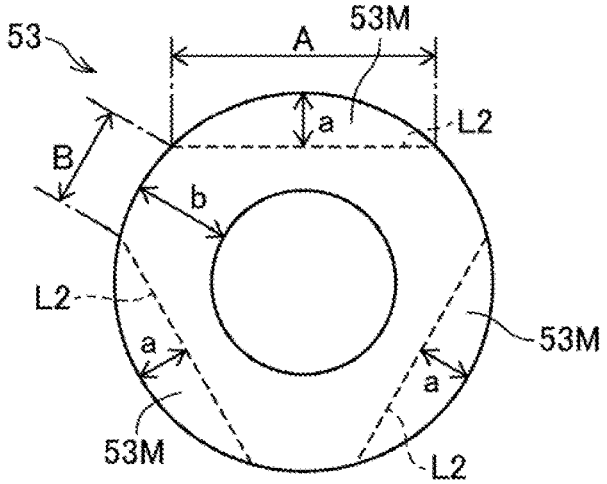
FIG. 7A is a diagram illustrating a case where three bent parts are formed.
Figure 7B:
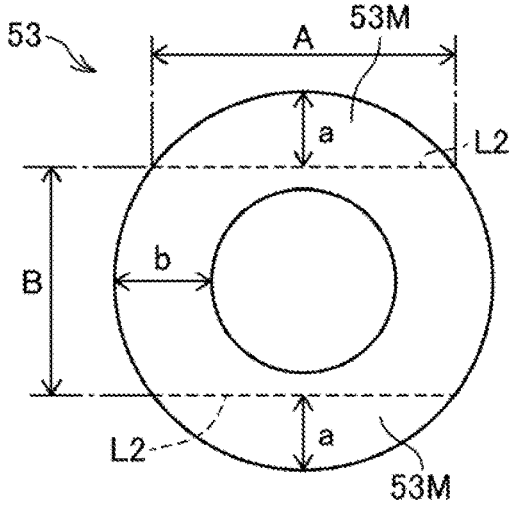
FIG. 7B is a diagram illustrating a case where two bent parts are formed.
Figure 7C:
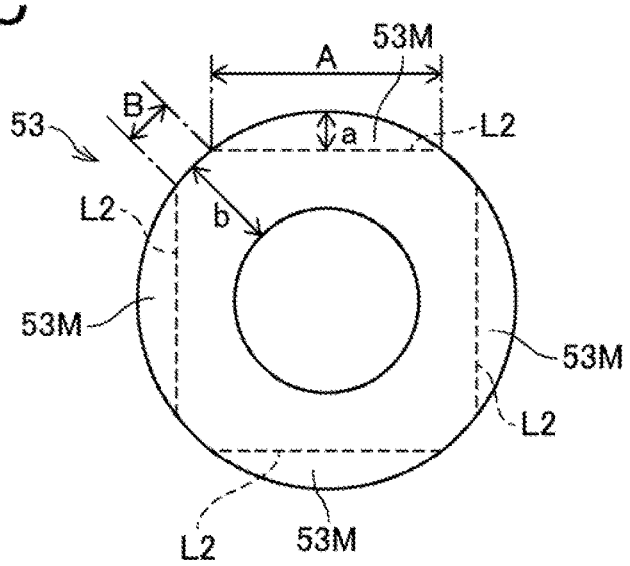
FIG. 7C is a diagram illustrating a case where four bent parts are formed.

Like in this embodiment, FIG. 7A illustrates a case where three bent parts 53M are formed, FIG. 7B illustrates a case where two bent parts 53M are formed, and FIG. 7C illustrates a case where four bent parts 53M are formed.

As illustrated in FIG. 7A, when three bent parts 53M are formed, the lengths of both the values "A" and "a" can be ensured, and the bent parts 53M can be enlarged while suppressing a spring constant. Accordingly, this structure is advantageous in vibration resistance and impact resistance. Further, since this structure is supported at three points, the structure is excellent in mounting stability.

As illustrated in FIG. 7B, when two bent parts 53M are formed, the lengths of both the values "A" and "a" can be ensured, while the structure is supported at two points. Accordingly, the structure is inferior in mounting stability.

As illustrated in FIG. 7C, when four or more bent parts 53M are formed, the value "A" and the value "a" are small and the spring constant is high, and thus the structure is inferior in robustness. In addition, when the shapes of the flange parts 53, the muffler-side portion 42A, and the like are not uniform, the structure is inferior in mounting stability.

As described above, in the spark arrester 51 according to this embodiment, at least the flange part 53 is formed of a spring member, and the flange part 53 includes the bent parts 53M that are telescopically bent by elastic deformation in the direction along the flow of exhaust gas. The bent part 53M is supported between the tail pipe 41 and the muffler 22 in a state where the elastic deformation of the bent parts 53M is allowed.

According to this structure, it is possible to easily support the spark arrester 51 by using the elasticity of the bent parts 53M, and to suppress vibrations of the spark arrester 51 due to the effect of the exhaust pressure or external vibration. Consequently, the occurrence of damage or sound in the spark arrester 51 due to vibrations of the spark arrester 51 can be prevented.

Each of the bent parts 53M has a structure in which a part of the flange part 53 is bent toward the downstream side of the exhaust gas. Accordingly, the bent parts 53M can be easily provided.

The flange part 53 is a member that is formed by bending, as the bent parts 53M, three outer peripheral portions at intervals in the circumferential direction toward the downstream side with respect to the annular plate material in a front view. Therefore, the flange part 53 can be easily fabricated. In addition, since the flange part 53 is fabricated using an annular plate material, the spark arrester 51 that is excellent in mounting stability and is advantageous in vibration resistance and impact resistance can be obtained.

The movement of the spark arrester 51 along with the elastic deformation of the bent parts 53M allows the spark arrester 51 to be provided at a position where an external appearance is visible from the tail pipe 41 constituting the exhaust port. Accordingly, the state of the spark arrester 51 can be easily checked, and it can be easily checked whether a maintenance work, such as cleaning, is required.

In addition, the spark arrester 51 is provided at a position where a part of the spark arrester 51 projects from the tail pipe 41 depending on the exhaust gas pressure acting on the spark arrester 51. Therefore, the clogged state or the like of the spark arrester 51 can be easily checked.

In this structure, the muffler 22 is formed on an elliptic section that is longer in the vertical direction than in the front-and-back direction, and the spark arrester 51 is provided on the front surface 22F that has the widest area. Therefore, the spark arrester 51 can be easily accessed, and a maintenance work, such as cleaning, can be easily performed.

Second Embodiment

A second embodiment differs from the first embodiment in that the spark arrester 51 is attached to the downstream end of the exhaust pipe 21.

Figure 8:
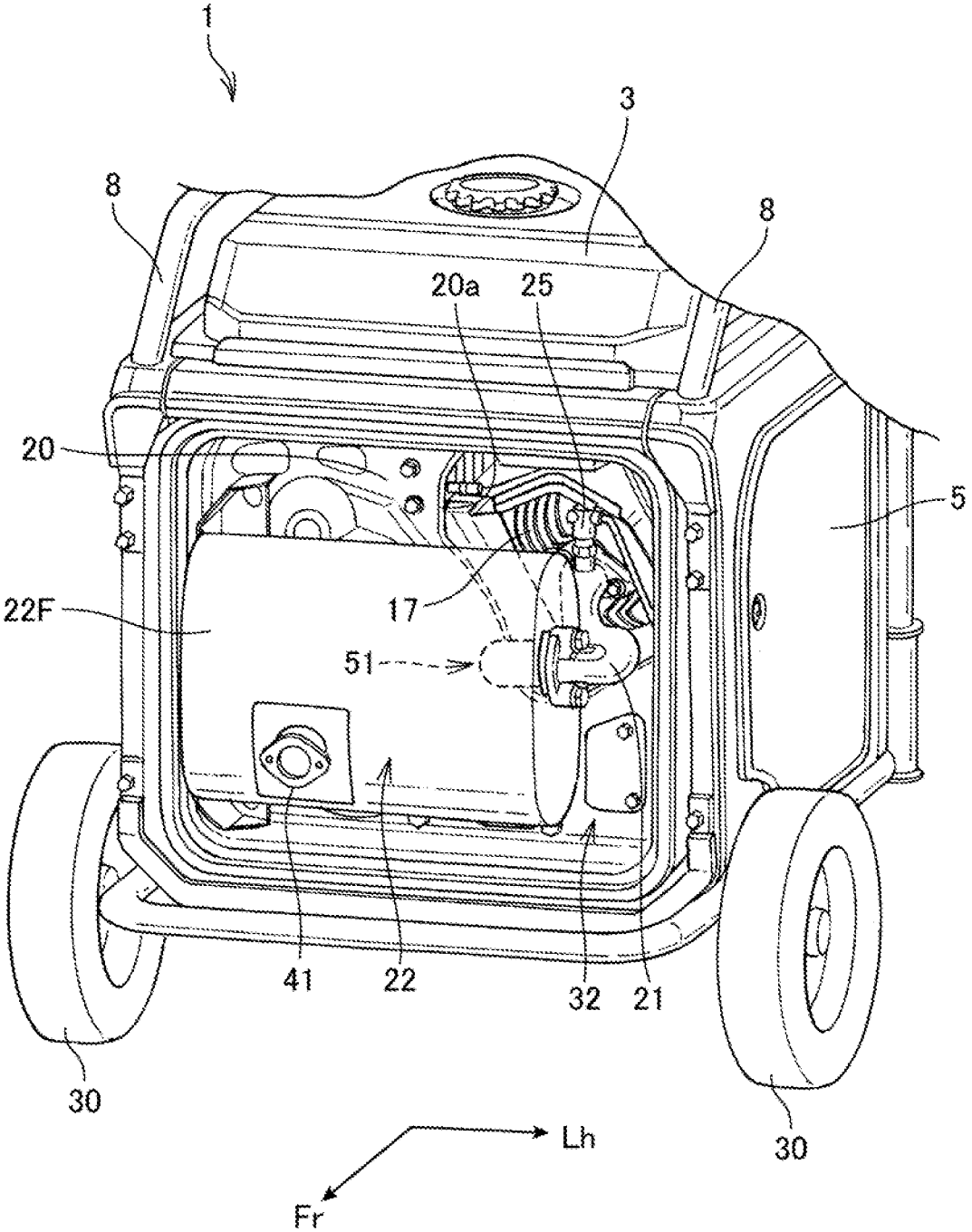
FIG. 8 is a perspective view of an engine generator to which an exhaust device according to a second embodiment is applied.
Figure 9:
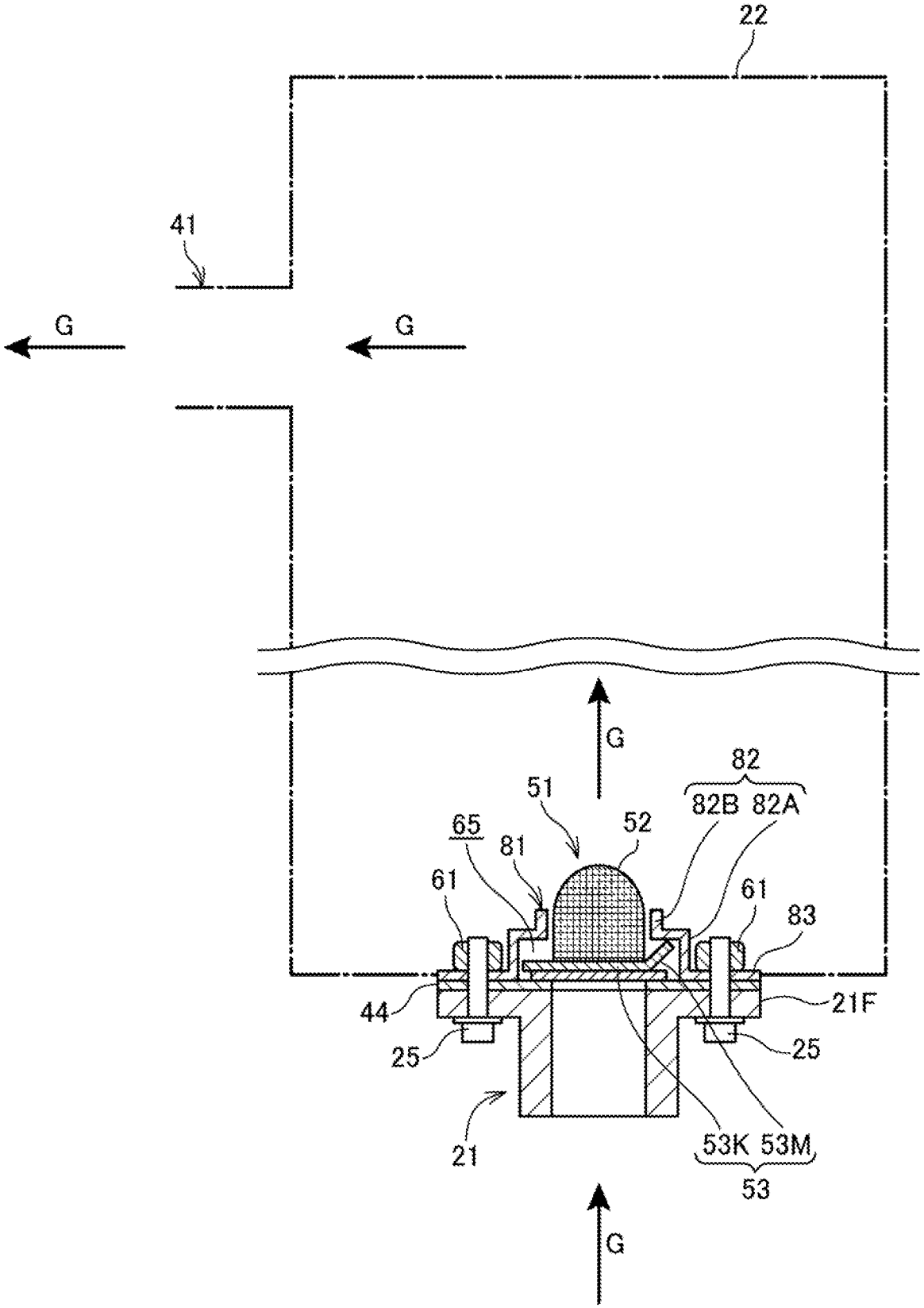
FIG. 9 is a schematic top view illustrating a connecting section between a tail pipe and an exhaust pipe of a muffler.

FIG. 8 is a perspective view of the engine generator 1 to which an exhaust device according to the second embodiment is applied. FIG. 9 is a schematic top view illustrating a connecting section between the tail pipe 41 and the exhaust pipe 21 of the muffler 22. Components similar to those of the first embodiment are denoted by the same reference numerals, and repeated descriptions thereof are omitted.

As illustrated in FIGS. 8 and 9, the flange part 21F is provided at the downstream end of the exhaust pipe 21. Between the flange part 21F and the muffler 22, a fixing member 81 to be fixed to the flange part 21F with the space 65, which accommodates the flange part 53 of the spark arrester 51, is provided.

The fixing member 81 includes a tubular main body part 82 through which the net-like main body part 52 of the spark arrester 51 penetrates, and a flange part 83 with a diameter enlarged at the upstream end of the main body part 82. The main body part 82 and the flange part 83 are integrally formed. The flange part 83 is joined with the exhaust pipe 21 and the muffler 22 by using the pair of fastening members 25 for fastening the exhaust pipe 21 to the muffler 22.

In the main body part 82, an exhaust pipe 21-side portion 82A (hereinafter referred to as an exhaust-pipe-side portion 82A) is formed with a diameter larger than that of a portion 82B located on the opposite side of the exhaust pipe 21 (hereinafter referred to as a downstream-side portion 82B). As illustrated in FIG. 9, the flange part 53 of the spark arrester 51 is disposed in the space 65 formed between the exhaust-pipe-side portion 82A and the muffler 22.

With this structure, the flange part 53 of the spark arrester 51 is nipped between the main body part and the muffler 22.

Also, in the second embodiment, like in the first embodiment, it is possible to obtain the advantageous effect that the spark arrester 51 can be easily supported by using the elasticity of the bent parts 53M provided on the spark arrester 51 and vibrations of the spark arrester 51 due to the effect of the exhaust pressure or external vibration can be suppressed.

In addition, in the second embodiment, the spark arrester 51 is disposed in the muffler 22, which eliminates the need for additionally ensuring an arrangement space for the spark arrester 51 outside of the muffler 22.

The embodiments described above are merely examples of the present invention, and the present invention can be arbitrarily modified and applied without departing from the scope of the present invention.

Figure 10A:
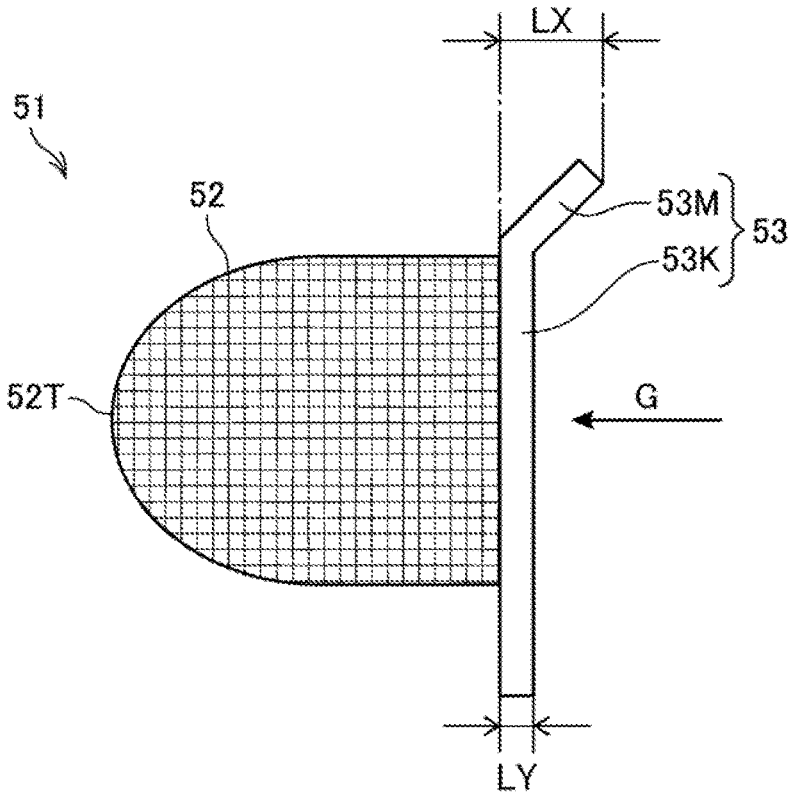
FIGS. 10A and 10B are diagrams each illustrating a modified example of a bent part of the spark arrester.
Figure 10B:
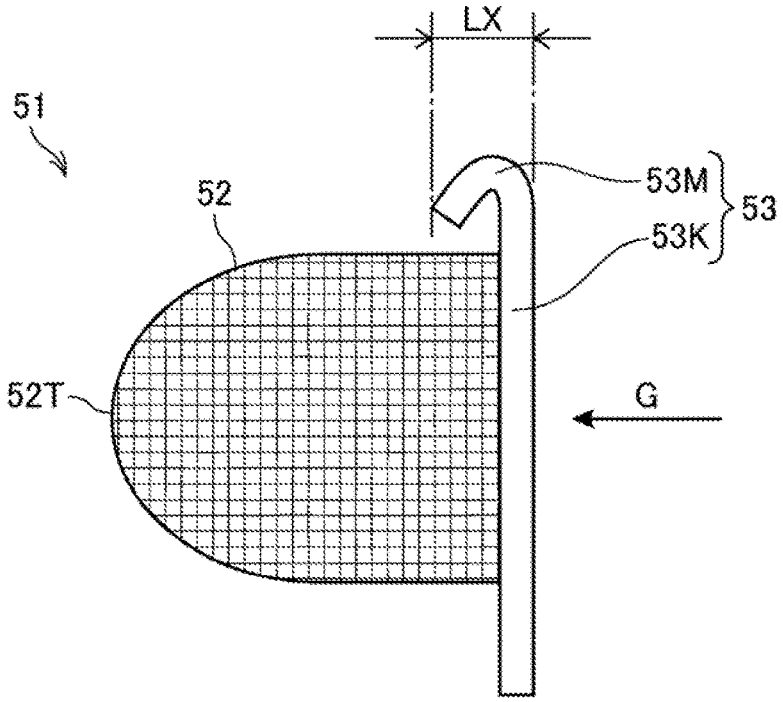

For example, the bent parts 53M of the spark arrester 51 are not limited to those illustrated in the embodiments described above. Any parts can be used as the bent parts 53M, as long as the bent parts 53M have a shape that is telescopically bent by elastic deformation in the direction along the flow of exhaust gas. For example, as illustrated in FIG. 10A, the bent parts 53M may be bent toward the downstream side of the exhaust gas, or may be bent in a curved shape as illustrated in FIG. 10B.

The number of the bent parts 53M is not limited to three, and the shape of each of the flange parts 53 of the spark arrester 51 is not limited to the annular shape. That is, the bent parts 53M and flange parts 53 can be appropriately changed as long as the spark arrester 51 can be appropriately held.

The case where the present invention is applied to the engine generator 1 has been described above. However, the present invention is not limited to this case. The present invention can be widely applied to various exhaust devices (exhaust devices equipped with a spark arrester) including a spark arrester.

REFERENCE SIGNS LIST

1 engine generator
2 housing
3 fuel tank
4 front cover
5 maintenance cover
7 control panel
9 cooled air intake port
10 cooled air discharge port
13 fan
15 generator
16 engine
21 exhaust pipe (exhaust device)
21F, 43, 53 flange part
22 muffler (exhaust device)
22F front surface of muffler
25, 45 fastening member
32 exhaust box
41 tail pipe (exhaust port)
42A muffler-side portion of tail pipe
402B downstream-side portion of tail pipe
44 gasket
51 spark arrester
52 main body part
53K annular member
53M bent part
65 space
61 fixing member
82A exhaust-pipe-side portion of fixing member
82B downstream-side portion of fixing member

What is claimed is:

1. A muffler comprising a spark arrester and a main body, the main body has a tubular shape and has an inside in which the spark arrester is disposed, wherein the spark arrester includes a main body part and a flange part, said main body part having a net portion through which exhaust gas passes, said flange part having a diameter enlarged from the main body part and being formed of a spring member, the flange part includes: an annular member having a predetermined thickness; and a bent part, said bent part extending from a periphery of said annular member and being telescopically bent with respect to the annular member by elastic deformation in a direction along a flow of the exhaust gas, the main body includes a downstream-side portion and an upstream-side portion, the upstream-side portion is disposed at an upstream side of the downstream-side portion and has an inner diameter larger than an inner diameter of the downstream-side portion, the main body is formed with a size that is equal to or smaller than an inner diameter of the downstream-side portion and the main body is disposed inside the downstream-side portion, the flange part is formed with a size that is equal to or larger than the inner diameter of the downstream-side portion and the flange part is accommodated in a space formed inside the upstream-side portion, and in the direction along the flow of the exhaust gas, a length of the space is set to be greater than the predetermined thickness, to be equal to or less than a natural length of the bent part and to be a length to further allow the elastic deformation of the bent part by an exhaust gas pressure acting on the spark arrester, whereby the bent part is supported by the upstream-side portion.

2. The muffler according to claim 1, wherein the bent part has a structure in which a part of the flange part is bent toward one of an upstream side and a downstream side of the exhaust gas.

3. The muffler according to claim 2, wherein the annular member comprises a plate material and is formed such that three outer peripheral portions of the plate material, which are annular in a front view, are bent, as the bent part, toward one of an upstream side and a downstream side of the exhaust gas, the three outer peripheral portions are disposed at intervals in a circumferential direction and spaced a distance from each other.

4. The muffler according to claim 1, wherein the muffler includes an exhaust port through which the exhaust gas is exhausted, and the spark arrester is provided at a position where an external appearance is visible from the exhaust port.

5. The muffler according to claim 4, wherein the spark arrester is provided at a position where a part of the spark arrester projects from the exhaust port depending on the exhaust gas pressure acting on the spark arrester.

* * * * *